United States Patent [19]

Joseph

[11] 3,996,108

[45] Dec. 7, 1976

[54] BRIQUETTING OF REACTIVE COAL CALCINATE WITH HIGH-TEMPERATURE COKE OVEN PITCH

[75] Inventor: Robert T. Joseph, Richboro, Pa.

[73] Assignee: FMC Corporation, Philadelphia, Pa.

[22] Filed: Oct. 4, 1974

[21] Appl. No.: 512,838

Related U.S. Application Data

[63] Continuation-in-part of Ser. No. 349,294, April 9, 1973, abandoned.

[52] U.S. Cl. ..... 201/6; 201/8; 201/22

[51] Int. Cl.[2] ..... C10B 45/02; C10B 53/00

[58] Field of Search ..... 201/5, 6, 8, 20–23, 201/31, 39

[56] References Cited

UNITED STATES PATENTS

| | | | |
|---|---|---|---|
| 3,140,241 | 7/1964 | Work | 201/5 |
| 3,623,999 | 11/1971 | Juntgen | 201/5 |
| 3,661,719 | 5/1972 | Kelmar | 201/20 |

*Primary Examiner*—Norman Yudkoff
*Assistant Examiner*—Martin G. Mullen

[57] ABSTRACT

In the production of reactive form coke of the sort described in Work et al., U.S. Pat. Nos. 3,140,241, 3,140,242 and 3,184,293, where a low-temperature reactive coal calcinate is mixed with a binder and formed into shapes which are cured in an oxygen-containing atmosphere and then calcined, the use of high-temperature coke oven pitch as binder for the briquettes is made possible by adding to the calcinate, before mixing with the binder, at least about 3.0% by weight of water based on the weight of calcinate.

2 Claims, No Drawings

BRIQUETTING OF REACTIVE COAL CALCINATE WITH HIGH-TEMPERATURE COKE OVEN PITCH

CROSS REFERENCE TO RELATED APPLICATION

This application is a continuation-in-part of application Ser. No. 349,294, filed Apr. 9, 1973, and now abandoned.

This invention is concerned with the production of form coke shapes from charred coal and bituminous binder, and especially with the production of highly reactive shapes of good mechanical properties, useful, for example, in the production of iron in blast furnaces.

In Work et al., U.S. Pat. Nos. 3,140,241 and 3,140,242 of July 7, 1964, there are described processes for making briquettes which are useful as substitutes for by-product oven coke, even in blast furnaces. According to those patents, ground coal is dried and heated to at least 250° F and below tar-producing temperatures, in the presence of oxygen which may be added to the gas in which the coal is suspended (U.S. Pat. No. 3,140,241) or be present in the coal (U.S. Pat. No. 3,140,242), to produce catalyzed coal particles. These particles are then shock-heated to tar-producing temperatures, typically 500° to 900° F, in a fluidized-bed carbonizer or series of them, to remove substantially all of the condensible vapors (tar) overhead; the char so produced, free of tars, is the further heated to higher temperatures, typically 1400° to 1600° F gas exit temperature, to remove noncondensible volatiles to produce a calcinate which contains preferably not in excess of about 3% of volatiles but at least 1% of hydrogen. The calcinate is then cooled in an inert atmosphere to a temperature at which it can be handled in air. The cooled calcinate is then blended with a bituminous binder, and formed into briquettes. The binder is preferably made from the tar produced in the carbonizer, by air-blowing to a pitch which is solid at ambient temperatures. The briquettes are cured in the presence of oxygen; an exothermic reaction occurs, apparently between oxygen and the calcinate-pitch mixture, which produces an amalgamation of calcinate and binder. Air temperatures of about 375° to 450° F in the curing oven produce temperatures of 500° to 550° F in the interior of the briquettes during curing. The cured briquettes are then coked to remove volatiles to under about 3%.

In operating this process, one of the major problems encountered is the balancing of the calcinate and binder yields to ensure getting strong briquettes. Some coals do not produce enough tar to make sufficient binder, thereby necessitating the use of supplemental binder. In some cases, the tar yield is so low that it becomes desirable to eliminate the tar recovery system entirely, and obtain binder elsewhere. This eliminates the capital cost of the tar recovery system, and yields the fuel value of the tar vapors as an asset in operations, to offset the cost of purchasing binder.

Purchased binder often presents problems in operation and briquetting quality. Low-temperature coal pitches can be used without problems, and some other pitches as well. But the commonly available low-cost high-temperature pitches obtained from conventional by-product coke ovens present serious operating difficulties. Even at high pitch-calcinate ratios, it is at best difficult and sometimes impossible to make satisfactory briquettes on conventional roll-briquetting machines; where briquettes can be made, the machines tend to be racked in the process, so that excessive wear results.

Consequently, it has been uneconomic to use ordinary by-product coke oven pitches as the binder for reactive coal calcinate.

This invention aims to provide a means for utilizing by-product coke oven pitch as the binder for briquetting reactive calcinates made by the processes of the Work et al. U.S. Pat. Nos. 3,140,241 and 3,140,242.

This object is obtained, in accordance with this invention, by using calcinate made by (1) heating ground coal to at least 250° F and below tar-producing temperatures in the presence of oxygen to produce catalyzed coal particles; (2) shock-heating the catalyzed particles to tar-producing temperatures, typically 500° to 900° F, in a fluidized-bed carbonizer or series of them, to remove substantially all of the condensible vapors overhead; (3) then further heating the particles to higher temperatures, typically 1400° to 1600° F gas exit temperature, to remove noncondensible volatiles to produce a reactive coal calcinate which contains preferably not in excess of about 3% of volatiles, but at least 1% of hydrogen; and (4) cooling the calcinate in an inert atmosphere to a temperature at which it can be handled in air; water is then applied to the calcinate whereby it adsorbs a minimum of about 3% by weight of the calcinate up to the saturation level of the calcinate i.e. the point at which the calcinate ceases to take-up anymore water (about 100% of calcinate weight). The wet calcinate is then thoroughly blended with the binder, a by-product coke oven pitch, and the mixture is briquetted to produce green briquettes. These are cured in an oxygen-containing atmosphere to produce strong cured briquettes which are desirably coked to reduce volatiles to under about 3%.

This invention deals with the briquetting of reactive coal calcinate made with bituminous binder in accordance with U.S. Pat. Nos. 3,140,241 and 3,140,242. These calcinates are produced in the manner described in the discussion herein of the prior art. They may be made from any rank of coal from lignite to anthracite. The specific variations in heating conditions are fully described in the said patents.

The production of strong briquettes from these calcinates requires mixing the calcinate with binder — generally 12 to 25% of total briquette weight — to produce a mix which is pressed into green briquettes on a briquetting machine, generally roll-briquetting machines. These green briquettes must be strong enough so that they can be fed to curing ovens, where they are heated in the presence of oxygen to cause a reaction to occur between the reactive calcinate and binder, to produce a homogeneous product. Typically, the gas temperature is sufficiently high to produce an exotherm which brings the briquette interiors to about 500° to 550° F (maximum about 575° F); the cured briquettes may be used as such, or be coked to reduce volatiles to make them more satisfactory for blast furnace uses.

As pointed out above in the discussion of the processes described in the Work et al. U.S. Pat. Nos. 3,140,241 and 3,140,242, while the binder is preferably produced in process, some coals do not yield sufficient binder to make good briquettes with the reactive calcinate, so that supplemental binder must be purchased; in some cases, the balance is so poor that it is economically superior to eliminate the tar recovery system from the plant and to purchase all the binder. Heretofore, it has not been practical to use the inexpensive commonly available by-product coke oven pitches as the sole binder.

The adsorption of 3% or more of water onto the reactive calcinate, before mixing it with binder, makes it possible to produce mixes of calcinate and by-product coke oven pitches which can be briquetted on roll-briquetting machines without difficulty. It is not known how the water acts, but whereas a mix which does not have enough water adsorbed onto the calcinate will either rack the machine badly or simply not form briquettes, mixes identical except for adsorbed water work smoothly and produce good green briquettes which cure and coke into acceptable final products.

At least about 3% of adsorbed water is needed to show improved results; good results are obtained up to about 50% of the weight of calcinate. Typical calcinates will adsorb up to about their own weight of water. Near and above the adsorptive limit, excess water will separate out either during the operation of mixing with binder, or be forced out on the briquetting press. This water does not render the process inoperative, but is a nuisance, so that it is desirable to avoid excess water.

By-product coke oven pitches of a wide range of softening points can be used. I prefer the commonly available by-product coke oven pitches with softening points from about 35° to 100° C.

The following examples are given by way of illustration and are not to be deemed limiting of the invention.

EXAMPLE 1

Following the procedures of coal pyrolysis disclosed in U.S. Pat. No. 3,140,241 to Work et al., a 27% volatile, high agglomerative coal having a coke button of 6 to 7 is ground in a hammer mill to produce ground coal particles substantially all of which pass a No. 8 mesh screen and at least 95% of which is retained on a No. 325 mesh screen. The ground coal particles are then heated in a series of three fluid bed stages under the following conditions:

| | |
|---|---|
| Total Length of Run, Hours | 48 |
| Total Dry Coal Fed, lbs | 4190 |
| Catalyzing Stage: | |
| Catalyzer Inside Diameter, Inches | 10 |
| Temperature of Fluid Bed, ° F | 800 |
| Residence Time, Minutes | 26 |
| Fluidizing Medium: | |
| Superficial Velocity, ft./sec. | 0.9 |
| Composition, Volume Percent: | |
| Oxygen | 11.5 |
| Nitrogen | 88.5 |
| Steam | none |
| Carbonizing Stage: | |
| Carbonizer Inside Diameter, Inches | 8 |
| Temperature of Fluid Bed, ° F | 950 |
| Residence Time, Minutes | 13 |
| Fluidizing Medium: | |
| Superficial Velocity, ft./sec. | 1.2 |
| Composition, Volume Percent: | |
| Oxygen | 8.5 |
| Nitrogen | 31.9 |
| Steam | 59.6 |
| Calcining Stage: | |
| Calciner Inside Diameter, Inches | 8 |
| Temperature of Fluid Bed, ° F | 1600 |
| Residence Time, Minutes | 18 |
| Fluidizing Medium: | |
| Superficial Velocity, ft./sec. | 1.5 |
| Composition Volume Percent: | |
| Oxygen | 21.0 |
| Nitrogen | 79.0 |

The calcinate is cooled in a fluidized bed using nitrogen as the fluidizing medium. The cooled calcinate is stored in sealed containers until ready for use.

The calcinate briquettes well with pitches made from low-temperature charring of coal. However, when a typical by-product coke oven pitch is used as the sole binder results are bad: a typical mix of 85% of calcinate and 15% of binder (57° C softening point by-product coke oven pitch) blends without evidence of trouble, but when the mix is fed to a standard roll-briquetting press at up to 8,000 pounds per lineal inch roll-separating force, the briquettes do not form. Added binder, up to an 80% calcinate 20% binder mix, fails to produce briquettes — the machine racks badly in the attempts.

The procedure is repeated in which there is adsorbed 10% of water onto the calcinate and this mixed in the ratio of 85 pounds (dry basis) of calcinate with 15 pounds of the same by-product coke oven pitch binder. The mix briquettes smoothly on the same machine, at reasonable roll separations pressure. The green briquettes are cured at 420° to 430° F atmospheric temperature in a 19% oxygen atmosphere for 120 minutes, and then coked for 20 to 30 minutes at 1630° to 1660° F. Excellent coked 1½ × 1½ × 1 inch pillow briquettes are obtained, with a crushing strength of 1,350 pounds.

The amounts of adsorbed water are reduced to 5%, 3% and 2%. At 5%, the machine runs satisfactorily, and produces good briquettes; at 3%, results are still fairly good, but the machine shows signs of strain; at 2%, briquettes are produced, but the machine racks badly.

EXAMPLE 2

Similar results are obtained using calcinate from other coals, such as (1) a 43% volatile sub-bituminous B-coal having zero coke button, and (2) a 33% volatile low-agglomerative value coal having a coke button from 1 to 1.5.

As understood herein, the binder softening points are Ring and Ball.

What is claimed is:

1. In the process of producing briquettes from mixtures of bituminous binder and reactive coal calcinates made by (1) treating ground coal to at least 250° F and below tar-producing temperatures in the presence of oxygen to produce catalyzed coal particles; (2) shock-heating the catalyzed particles to tar-producing temperatures, typically 500° to 900° F, in a fluidized-bed carbonizer or series of them, to remove substantially all of the condensible vapors overhead; (3) then further heating the particles to higher temperatures, typically 1400° to 1600° F gas exit temperature, to remove non-condensible volatiles to produce a reactive coal calcinate which contains preferably not in excess of about 3% of volatiles, but at least 1% of hydrogen; and (4) cooling the calcinate in an inert atmosphere to a temperature at which it can be handled in air, in which the calcinate and bituminous binder are mixed into a compressible blend, the blend is briquetted into green briquettes, and the green briquettes are cured in an oxygen-containing atmosphere to produce strong cured briquettes which can be coked to briquettes with a volatile content of under 3%, the improvement which comprises applying water to the calcinate before admixture of said calcinate with said bituminous binder whereby it absorbs a minimum of about 3% based on the weight of calcinate up to the saturation level of the calcinate, and using as the binder a by-product coke oven pitch.

2. The method of claim 1, in which the by-product coke oven pitch has a softening point between 35° and 100° C.

* * * * *